US008844196B2

(12) United States Patent
Park et al.

(10) Patent No.: US 8,844,196 B2
(45) Date of Patent: Sep. 30, 2014

(54) CURTAIN INTEGRATED DOOR REGULATOR STRUCTURE

(71) Applicant: Hyundai Motor Company, Seoul (KR)

(72) Inventors: Hoo Sang Park, Hwaseong-si (KR); Jung Ho Han, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/909,949

(22) Filed: Jun. 4, 2013

(65) Prior Publication Data

US 2014/0158309 A1 Jun. 12, 2014

(30) Foreign Application Priority Data

Dec. 10, 2012 (KR) ..... 10-2012-0142709

(51) Int. Cl.

| | |
|---|---|
| ***E05F 11/40*** | (2006.01) |
| ***E05F 11/38*** | (2006.01) |
| ***E05F 15/16*** | (2006.01) |
| ***E06B 9/70*** | (2006.01) |

(52) U.S. Cl.

CPC ..... *E06B 9/70* (2013.01)
USPC ..... 49/63; 49/136; 49/349

(58) Field of Classification Search

USPC ..... 49/61, 63, 65, 136, 73.1, 142, 348, 349, 49/352, 374; 74/352; 296/146.2, 97.9, 296/97.11

See application file for complete search history.

(56) References Cited

U.S. PATENT DOCUMENTS

| | | | | |
|---|---|---|---|---|
| 4,331,359 | A * | 5/1982 | Sheldon | 296/146.2 |
| 4,773,697 | A * | 9/1988 | Svensson | 296/152 |
| 4,930,255 | A * | 6/1990 | Sea | 49/63 |
| 5,165,188 | A * | 11/1992 | Tsiros | 49/63 |
| 6,052,946 | A * | 4/2000 | Isomura | 49/352 |
| 6,523,880 | B1 * | 2/2003 | Yako | 296/97.1 |
| 7,806,461 | B2 * | 10/2010 | Patterson | 296/146.2 |
| 8,439,433 | B2 * | 5/2013 | Kim et al. | 296/214 |
| 2008/0034667 | A1 * | 2/2008 | Fischer | 49/502 |
| 2008/0034668 | A1 * | 2/2008 | Fischer | 49/502 |

FOREIGN PATENT DOCUMENTS

| | | | |
|---|---|---|---|
| JP | 2002-322864 | A | 11/2002 |
| JP | 2003-214028 | A | 7/2003 |
| JP | 2003-306037 | A | 10/2003 |
| JP | 2005-271670 | A | 10/2005 |

(Continued)

OTHER PUBLICATIONS

Korean Notice of Allowance issued in Korean Patent Application No. 10-2003-0082903 dated Jun. 18, 2014.

*Primary Examiner* — Katherine Mitchell
*Assistant Examiner* — Justin Rephann
(74) *Attorney, Agent, or Firm* — McDermott Will & Emery LLP

(57) ABSTRACT

A curtain integrated door regulator structure includes a motor, a drive gear, a drum retainer, a glass driving drum, a curtain driving drum, gear keys and key grooves. The motor generates a rotational driving force to rotate a driving shaft. The drive gear has a shaft receiving hole into which a driving shaft of the motor is fitted. The drum retainer has a spiral groove shaft supporting part spirally coupled to a spiral protrusion disposed on an outer circumference of the drive gear. The glass driving drum and the curtain driving drum are rotatably received in the drum retainer and disposed at an outer side of the drive gear. The gear keys are disposed on the outer circumference of the drive gear. The key grooves are formed in the glass driving drum and the curtain driving drum, respectively, and have a shape corresponding to that of the gear keys.

10 Claims, 8 Drawing Sheets

(56) References Cited

FOREIGN PATENT DOCUMENTS

| | | | |
|---|---|---|---|
| JP | 2008-013950 | A | 1/2008 |
| JP | 2011-132764 | A | 7/2011 |
| KR | 2005-0049044 | A | 5/2005 |
| KR | 10-0529182 | B1 | 11/2005 |
| KR | 10-0726268 | B1 | 6/2007 |

* cited by examiner

<Prior Art>

CURTAIN INTEGRATED DOOR REGULATOR STRUCTURE

CROSS-REFERENCE TO RELATED APPLICATION

This application is based on and claims benefit of priority to Korean Patent Application No. 10-2012-0142709, filed on Dec. 10, 2012 in the Korean Intellectual Property Office, the entire contents of which are hereby incorporated by reference.

TECHNICAL FIELD

The present inventive concept relates to a door regulator structure, and more particularly, to a door regulator structure connecting a door curtain and a door glass to a single driving means to allow both of the door curtain and the door glass to be automatically operated.

BACKGROUND

According to the prior art, a door regulator structure automatically opening or closing a door glass has been widely used. FIG. 1 is a view showing a door regulator structure of a door glass according to the prior art.

The door regulator structure has a structure in which when a user presses an up or down button, a motor 20 is rotated to rotate a drum fixed to a shaft of the motor, such that a glass cable 81 wound around the drum is moved to raise or lower a glass 8.

Meanwhile, vehicles having high-class specifications have been further installed with a door curtain, in addition to a power window. However, the door curtain was configured separately from the door regulator structure according to the prior art described above, such that the door curtain was manually driven or operated by a separate motor other than the motor 20.

However, a structure in which a separate driving means is further provided in order to automatically move only a curtain causes an increase in weight and cost, and a structure of manually operating the curtain decreases convenience of a user as compared with a structure of automatically operating the curtain.

SUMMARY

Accordingly, the present inventive concept has been made to solve the above-mentioned problems occurring in the prior art while advantages achieved by the prior art are maintained intact.

One aspect of the present inventive concept relates to a curtain integrated door regulator structure capable of automatically and independently operating a glass and a curtain using a single driving means.

One aspect of the present inventive concept encompasses a curtain integrated door regulator structure including: a motor generating rotational driving force to rotate a driving shaft; a drive gear provided with a shaft receiving hole into which a driving shaft of the motor is fitted; a drum retainer provided with a spiral groove shaft supporting part spirally coupled to a spiral protrusion formed on an outer circumference of the drive gear; a glass driving drum and a curtain driving drum rotatably received in the drum retainer and disposed at an outer side of the drive gear; gear keys formed on the outer circumference of the drive gear; and key grooves formed in the glass driving drum and the curtain driving drum, respectively, and having a shape corresponding to that of the gear keys, wherein the driving shaft and the shaft receiving hole are movable in an axial direction and are coupled to each other so as to transfer rotational force in a rotation direction, and wherein the spiral protrusion formed on the outer circumference of the drive gear moves along a spiral groove of the spiral groove shaft supporting part of the drum retainer while the drive gear is rotated by rotation of the motor, such that the drive gear moves in the axial direction while being rotated, and the drive gear moves in the axial direction, such that the gear key of the drive gear is selectively engaged with the key groove of the glass driving drum or the key groove of the curtain driving drum, thereby rotating the glass driving drum or the curtain driving drum.

The curtain integrated door regulator structure may further include stoppers fixing the glass driving drum and the curtain driving drum that is not engaged with the gear keys of the drive gear so as not to be rotated.

The outer circumference of the drive gear may be provided with jaws, the stoppers may be provided with jaw receiving parts, respectively, have the jaws received in the jaw receiving parts thereof, respectively, such that they are rotatably coupled to the drive gear, and include stopper parts formed in a direction parallel with the axial direction of the drive gear, respectively, and the drum retainer may be provided with guide grooves guiding the stopper parts in the direction parallel with the axial direction of the drive gear, respectively, such that when the drive gear moves in the axial direction, the stoppers also move in the axial direction by the jaw receiving parts, and rotation of the stoppers is prevented by the stopper parts and the guide grooves during a period in which the stoppers move in the axial direction together with the drive gear.

The key groove of the glass driving drum and the key groove of the curtain driving drum may be disposed to be spaced apart from each other by at least an axial length of the gear key formed on the outer circumference of the drive gear.

During a period in which the gear key of the drive gear is engaged with the key groove of the glass driving drum, the stopper part of the stopper may be engaged with the curtain driving drum, thereby preventing rotation of the curtain driving drum, and during a period in which the gear key of the drive gear is engaged with the key groove of the curtain driving drum, the stopper part of the stopper may be engaged with the glass driving drum, thereby preventing rotation of the glass driving drum.

The stoppers may be disposed at outer sides of the glass driving drum and the curtain driving drum in the axial direction of the drive gear.

BRIEF DESCRIPTION OF THE DRAWINGS

The foregoing and other features of the inventive concept will be apparent from more particular description of embodiments of the inventive concept, as illustrated in the accompanying drawings in which like reference characters may refer to the same or similar parts throughout the different views. The drawings are not necessarily to scale, emphasis instead being placed upon illustrating the principles of the embodiments of the inventive concept.

DETAILED DESCRIPTION OF THE PREFERRED EMBODIMENTS

Figure 1:
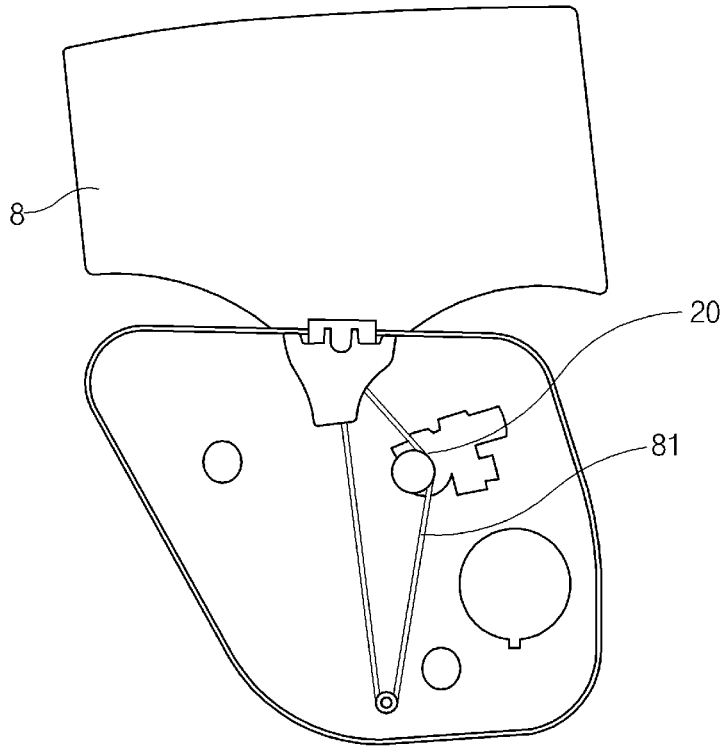
FIG. 1 is a view showing a door regulator structure of a door glass according to the prior art.

Examples of the present inventive concept will be described below in more detail with reference to the accompanying drawings. The examples of the present inventive concept may, however, be embodied in different forms and should not be construed as limited to the examples set forth herein. Like reference numerals may refer to like elements throughout the specification.

Figure 2:
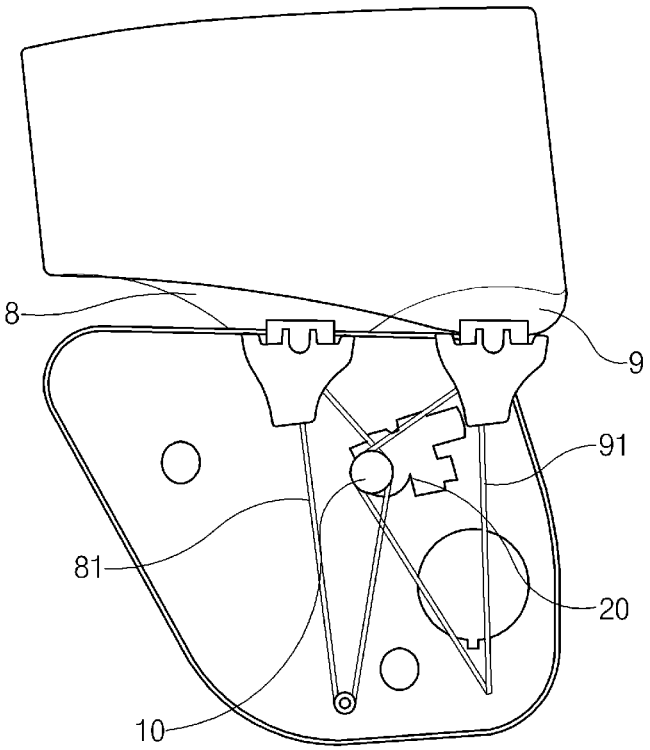
FIG. 2 is a view showing a door regulator structure of a curtain integrated door glass according to an exemplary embodiment of the present inventive concept.

FIG. 2 is a view showing a door regulator structure of a curtain integrated door glass according to an exemplary embodiment of the present inventive concept.

Referring to FIG. 2, in an exemplary embodiment of the present inventive concept, a glass driving drum and a curtain driving drum may be selectively driven by a single motor 20 and a glass cable 81 and a curtain cable 91 may be connected to the glass driving drum and the curtain driving drum, respectively, such that a glass 8 and a curtain 9 may ascend and descend by an operation of the motor. The door curtain 9 may be formed of a privacy coating PC glass and have a channel having a double rib operated at an inner side of the glass 8.

A door panel may be embedded with the motor 20 and a drum retainer 10 may be connected to a driving shaft of the motor, such that the motor may selectively drive the glass driving drum or the curtain driving drum, received in and supported by the drum retainer 10.

Figure 3:
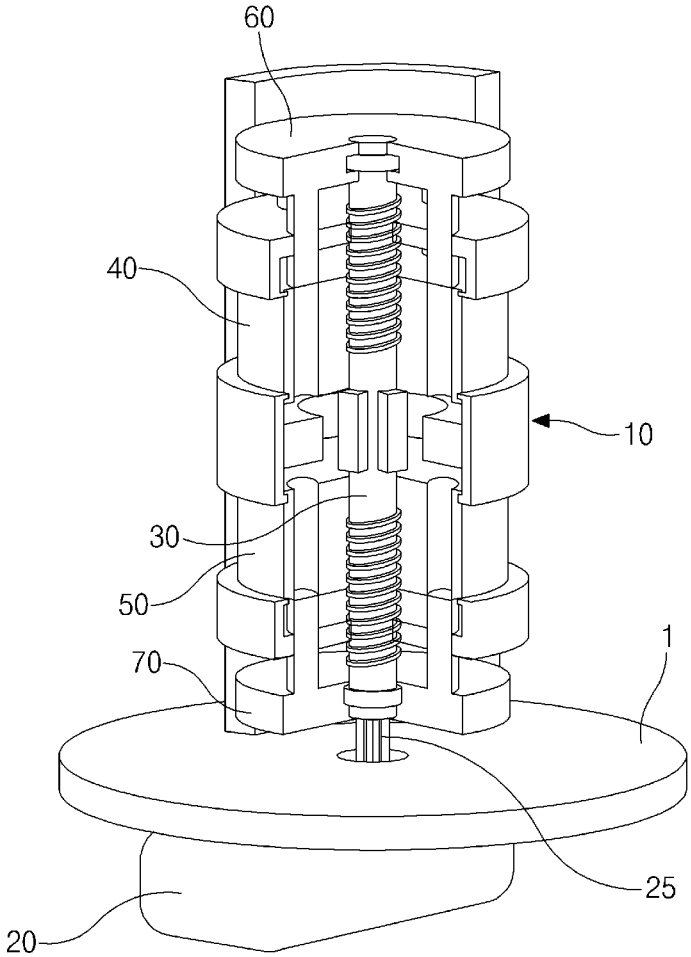
FIG. 3 is a cross-sectional perspective view of a door regulator structure according to an exemplary embodiment of the present inventive concept.
Figure 4:
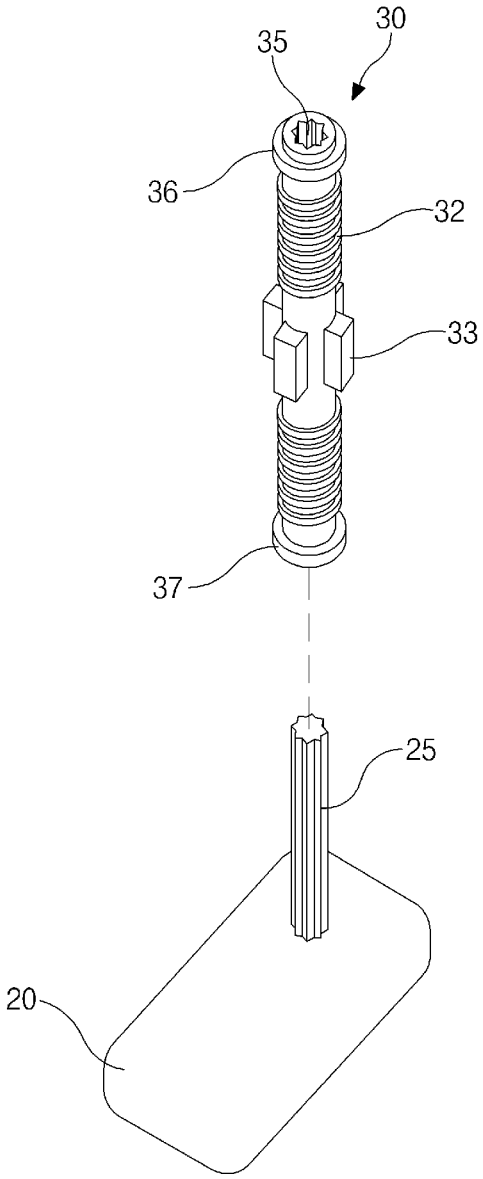
FIG. 4 is an exploded perspective view of a motor and a drive gear of the door regulator structure of FIG. 3.
Figure 5:
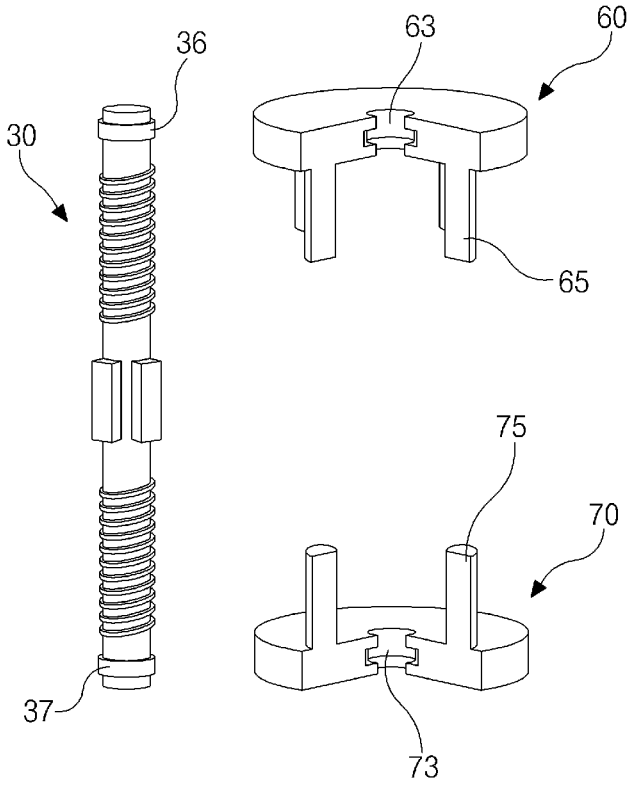
FIG. 5 is an exploded perspective view of the drive gear and a stopper of the door regulator structure of FIG. 3.
Figure 6:
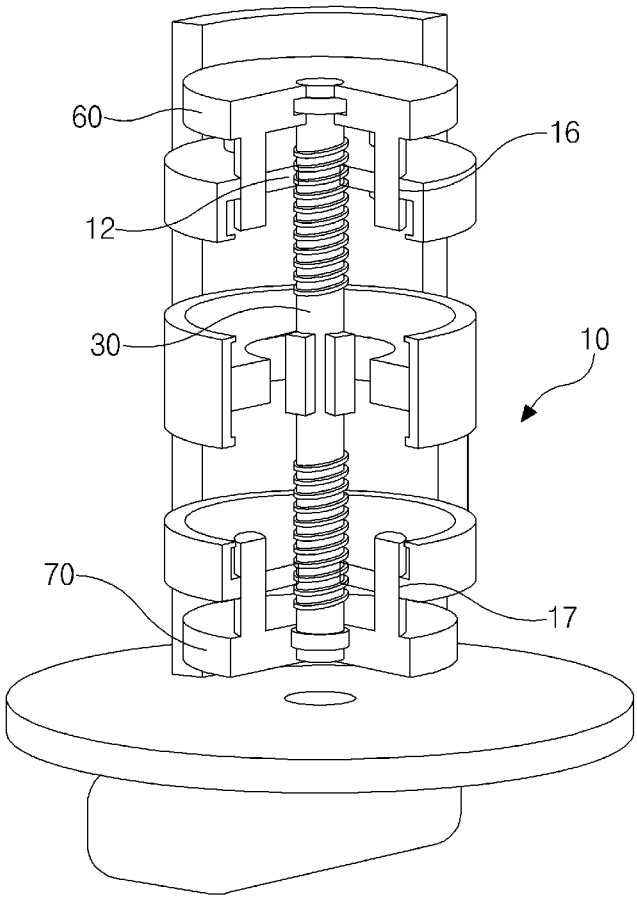
FIG. 6 is a cross-sectional perspective view showing a coupled state among the motor, the drive gear, the stopper, and a drum retainer of the door regulator structure of FIG. 3.
Figure 7:
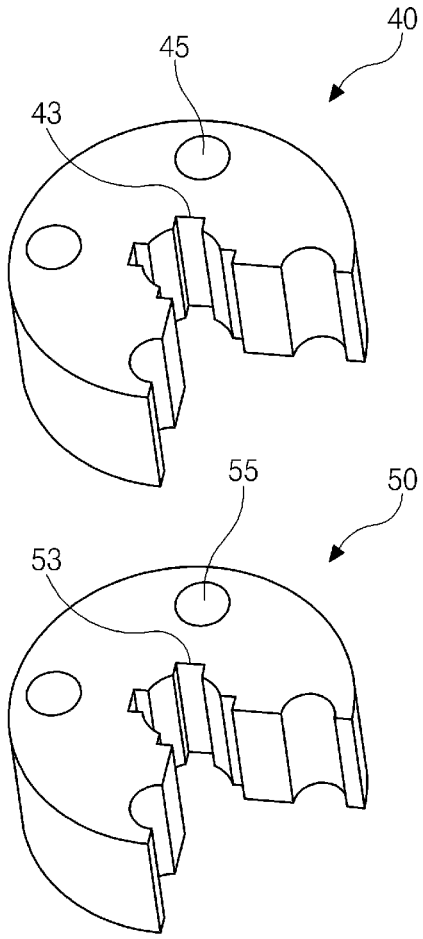
FIG. 7 is a partially cut-away perspective view showing internal structures of a glass driving drum and a curtain driving drum according to an exemplary embodiment of the present inventive concept.

FIG. 3 is a cross-sectional perspective view of the door regulator structure according to an exemplary embodiment of the present inventive concept. FIG. 4 is an exploded perspective view of a motor and a drive gear of the door regulator structure of FIG. 3. FIG. 5 is an exploded perspective view of the drive gear and a stopper of the door regulator structure of FIG. 3. FIG. 6 is a cross-sectional perspective view showing a coupled state among the motor, the drive gear, the stopper, and a drum retainer of the door regulator structure of FIG. 3. FIG. 7 is a partially cut-away perspective view showing internal structures of a glass driving drum and a curtain driving drum according to an exemplary embodiment of the present inventive concept.

Referring to FIG. 3, the door regulator structure according to an exemplary embodiment of the present inventive concept may include the motor 20 generating rotational driving force to rotate the driving shaft 25. As shown in the accompanying drawings (e.g., FIG. 4), the driving shaft 25 of the motor may have a polygonal cross-section shape, and a drive gear 30 into which the driving shaft 25 is fitted may be provided with a shaft receiving hole 35 also having a shape corresponding to the cross-sectional shape of the driving shaft 25. Therefore, when the driving shaft 25 is fitted into the shaft receiving hole 35, the rotational force of the driving shaft 25 may be transferred to the drive gear 30. However, since the shaft receiving hole 35 may not be fixed with respect to the driving shaft 25 in an axial direction, the drive gear 30 may be slidable in the axial direction of the driving shaft 25.

In addition, an outer circumference of the drive gear 30 is provided with a spiral protrusion 32 (see FIG. 4), and the drum retainer 10 disposed over the motor and fixed to a door module panel 1 on the accompanying drawings may be provided with a spiral groove shaft supporting part 12 (see FIG. 6) spirally coupled to the spiral protrusion 32 of the drive gear 30 and receiving the drive gear.

Therefore, when the motor 20 is rotated, the drive gear 30 may also be rotated and at the same time, be slidable in the axial direction of the driving shaft and be spirally coupled to the spiral groove shaft supporting part 12 (see FIG. 6) of the drum retainer 10. Accordingly, the spiral protrusion 32 (see FIG. 4) formed on the outer circumference of the drive gear 30 moves along a spiral groove of the spiral groove shaft supporting part 12 of the drum retainer 10 while the drive gear 30 is rotated by the rotation of the motor 20, such that the drive gear 30 moves in the axial direction while being rotated.

Therefore, in FIG. 3, when the motor 20 is rotated in a counterclockwise direction, the drive gear 30 moves upwardly while being rotated in the counterclockwise direction, and when the motor 20 is rotated in a clockwise direction, the drive gear 30 moves downwardly while being rotated in the clockwise direction.

Next, referring to FIG. 3, the drum retainer 10 has a glass driving drum 40 and a curtain driving drum 50 rotatably received therein. That is, the glass driving drum 40 and the curtain driving drum 50 in the drum retainer 10 are only rotated around an axis of the drive gear 30 in place without moving in a vertical direction in the accompanying drawings.

The glass driving drum 40 and the curtain driving drum 50 are also disposed at an outer side of the drive gear 30, and portions of the glass driving drum 40 and the curtain driving drum 50 disposed at the outer side of the drive gear 30 do not interfere with the spiral protrusion 32 (see FIG. 4) of the drive gear 30. Meanwhile, the portions of the glass driving drum 40 and the curtain driving drum 50 disposed at the outer side of the drive gear 30 may be provided with key grooves 43 and 53, respectively (see FIG. 7). The drive gear 30 may be provided with gear keys 33 on the outer circumference of partial sections of the drive gear 30 in the axial direction.

The gear keys 33 (see FIG. 4) and the key grooves 43 and 53 (see FIG. 7), which have a shape corresponding to each other, may be engaged with each other or disengaged from each other. When the gear keys 33 and the key grooves 43 and 53 are engaged with each other, rotational force is transferred therebetween.

Therefore, as described above, the drive gear 30 moves in the axial direction while being rotated, such that the gear key 33 of the drive gear is selectively engaged with the key groove 43 of the glass driving drum 40 or with the key groove 53 of the curtain driving drum 50, thereby making it possible to selectively rotate the glass driving drum 40 or the curtain driving drum 50.

For example, when the drive gear 30 ascends while being rotated in the counterclockwise direction in a state of FIG. 3, the gear key 33 and the key groove 43 of the glass driving drum 40 are engaged with each other, such that the glass driving drum is rotated, and when the drive gear 30 descends while being rotated in the clockwise direction in a state of FIG. 3, the gear key 33 and the key groove 53 of the curtain driving drum 50 are engaged with each other, such that the curtain driving drum is rotated. As described above, which of the glass driving drum 40 and the curtain driving drum 50 is selectively rotated may be determined according to a rotation direction and a vertical position of the drive gear.

In addition, the key groove 43 of the glass driving drum 40 and the key groove 53 of the curtain driving drum 50 may be disposed to be spaced apart from each other by at least an axial length of the gear key 33 formed on the outer circumference of the drive gear 30. Thus, a phenomenon that the gear key 33 is simultaneously engaged with the glass driving drum 40 and the curtain driving drum 50 to simultaneously rotate the glass driving drum 40 and the curtain driving drum 50 may be prevented.

Meanwhile, referring to FIG. 3, the curtain integrated door regulator structure as described above may further include stoppers 60 and 70 fixing the glass driving drum 40 and the curtain driving drum 50 that are not engaged with the gear keys 33 (see FIG. 4) of the drive gear so as not to be rotated.

More specifically, referring to FIG. 5, the outer circumference of the drive gear 30 may be provided with jaws 36 and 37 (see FIG. 4). The stoppers 60 and 70 may be provided with jaw receiving parts 63 and 73, respectively, to have the jaws 36 and 37 received in the jaw receiving parts 63 and 73 thereof, respectively, such that the stoppers 60 and 70 are rotatably coupled to the drive gear 30. The stoppers 60 and 70 may include stopper parts 65 and 75 formed in a direction parallel with the axial direction of the drive gear 30, respectively. The drum retainer 10 may be provided with guide grooves 16 and 17 (see FIG. 6) guiding the stopper parts 65 and 75 in the direction parallel with the axial direction of the drive gear 30, respectively, such that when the drive gear 30 moves in the axial direction, the stoppers 60 and 70 also move in the axial direction by the jaw receiving parts 63 and 73, and rotation of the stoppers 60 and 70 is prevented by the stopper parts 65 and 75 and the guide grooves 16 and 17 during a period in which the stoppers 60 and 70 move in the axial direction together with the drive gear 30.

Here, the stoppers 60 and 70 may be disposed at outer sides of the glass driving drum 40 and the curtain driving drum 50 in the axial direction of the drive gear 30 in a state in which the stoppers 60 and 70 maintain appropriate interval from the glass driving drum 40 and the curtain driving drum 50. With this configuration, during a period in which the gear key 33 of the drive gear is engaged with the key groove 43 of the glass driving drum 40, the stopper part 65 or 76 of the stopper 60 or 70 is engaged with the curtain driving drum 50, thereby making it possible to prevent rotation of the curtain driving drum 50, and during a period in which the gear key 33 of the drive gear 30 is engaged with the key groove 53 of the curtain driving drum 50, the stopper part 65 or 75 of the stopper 60 or 70 is engaged with the glass driving drum 40, thereby making it possible to prevent rotation of the glass driving drum 40.

Figure 8:
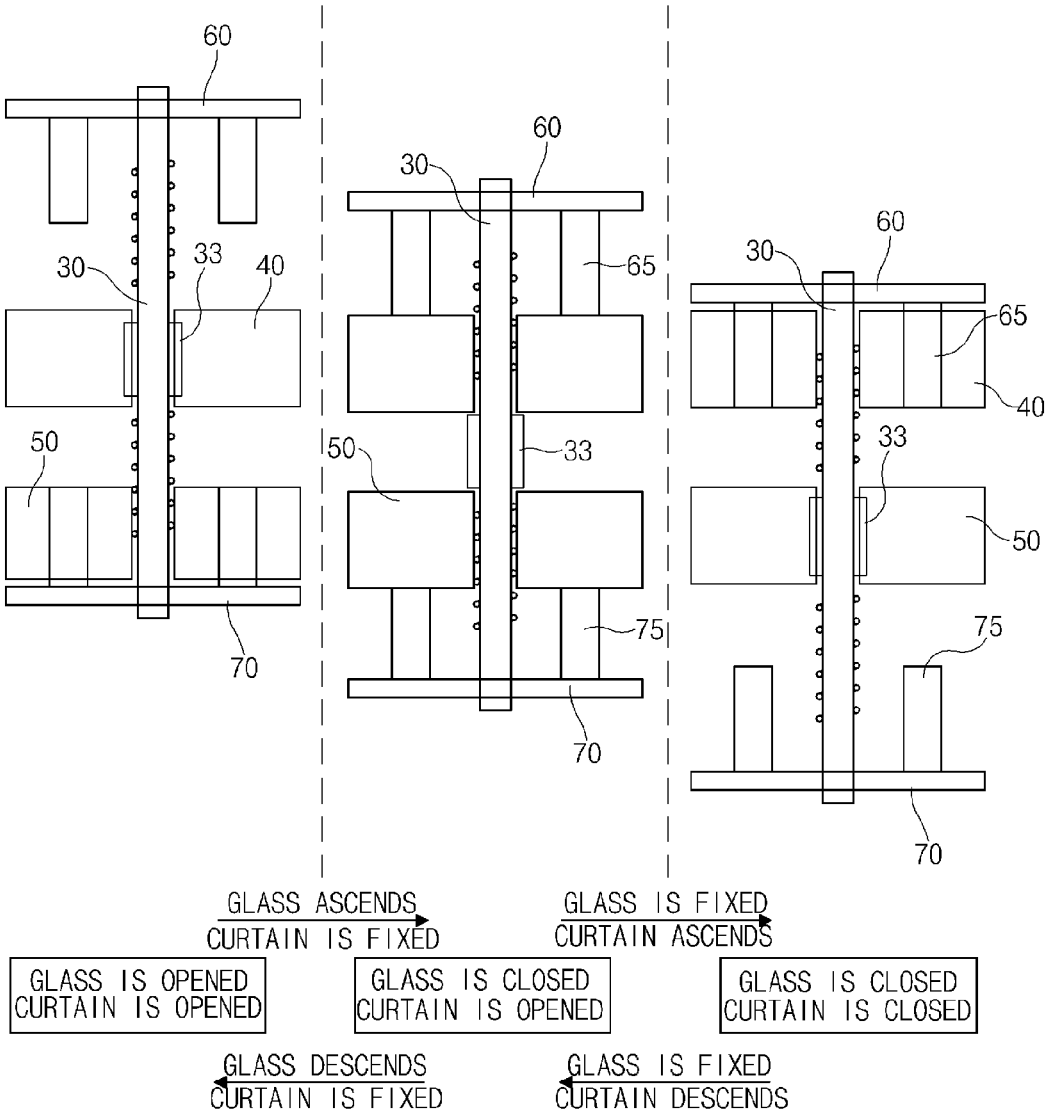
FIG. 8 is a view showing an operating principle and an operating logic of the glass driving drum and the curtain driving drum according to an exemplary embodiment of the present inventive concept.

FIG. 8 is a view showing an operating principle and an operating logic of the glass driving drum and the curtain driving drum according to an exemplary embodiment of the present inventive concept.

The door regulator structure according to an exemplary embodiment of the present inventive concept will be described with reference to FIG. 8. As shown on the left side of FIG. 8, in a state in which both of the glass and the curtain are opened, the drive gear 30 ascends at the highest height, such that the gear key 33 thereof is engaged with the glass driving drum 40 and the stopper part 75 of the second stopper 70 is fitted into a stopper hole 55 (see FIG. 7) of the curtain driving drum 50 to prevent the rotation of the curtain driving drum 50.

And the stopper part 65 of the second stopper 60 is fitted into a stopper hole 45 (see FIG. 7) of the curtain driving drum 40 to prevent the rotation of the curtain driving drum 40.

In this state, when a user presses an up button, the drive gear is rotated in the clockwise direction (when viewed downwardly from the top in FIG. 3 in the accompanying drawings) while the motor 20 is rotated in the clockwise direction, and the drive gear descends by a coupling structure between the spiral groove shaft supporting part 12 (see FIG. 6) of the drum retainer 10 and the spiral protrusion 32 (see FIG. 4) of the drive gear 30. Thus, when the drive gear 30 is rotated in the clockwise direction while descending up to a position of the drive gear 30 shown at the center of FIG. 8, since the gear key 33 is in a state in which it is engaged with the key groove 43, only the glass driving drum 40 is rotated in the clockwise direction, and the curtain driving drum 50 is engaged with the second stopper 70 until the drive gear 30 descends up to position of the drive gear 30 shown at the center of FIG. 8, such that the rotation of the curtain driving drum 50 is prevented. Therefore, the glass ascends and the curtain is fixed in a state in which the curtain is still opened.

In this state, when the user continuously presses the up button, the drive gear 30 is rotated in the clockwise direction while descending to thereby be engaged with the curtain driving drum 50. At this time, the first stopper 60 starts to be engaged with the glass driving drum 40 to prevent the rotation of the glass driving drum, and the second stopper 70 exits from the curtain driving drum, such that the second stopper 70 no longer fixes the curtain driving drum. Therefore, the glass driving drum is fixed without being rotated, such that the glass is maintained in a state in which the glass is closed, and the curtain driving drum 50 is rotated in the clockwise direction, such that the curtain ascends. Thus, when the drive gear 30 descends up to a position of the drive gear 30 shown in the right of FIG. 8, the curtain is also in a state in which the curtain is completely closed.

Then, when the user presses a down button in order to open the curtain, the drive gear 30 is rotated in the counterclockwise direction while ascending, such that the curtain driving drum is also rotated in the counterclockwise direction. Also at this time, the glass driving drum 40 is still in a state in which the rotation thereof is prevented by the first stopper 60. Therefore, the drive gear 30 rotates only the curtain driving drum in the counterclockwise direction while ascending up to the position of the drive gear 30 shown at the center of FIG. 8 to allow the curtain to descend. When the drive gear 30 arrives at the position of the drive gear 30 shown at the center of FIG. 8, the curtain is in a state in which the curtain is completely opened in a state in which the glass is closed and fixed.

In this state, when the user continuously presses the down button in order to open the glass, the drive gear 30 ascends, such that the gear key 33 thereof is disengaged from the curtain driving drum 50 and is engaged with the glass driving drum 40. At this time, the first stopper 60 exits from the glass driving drum 40, such that the rotation prevention state of the glass driving drum 40 is released, and the second stopper 70 starts to be engaged with the curtain driving drum, such that the rotation of the curtain driving drum 50 is prevented. Therefore, in this state, when the drive gear 30 rotates the glass driving drum 40 in the counterclockwise direction while ascending, the glass descends, and the curtain is fixedly maintained in a state in which the curtain is closed. Thus, when the drive gear 30 arrives at the position shown in the left of FIG. 8, the glass is completely opened.

That is, with the door regulator structure according to an exemplary embodiment of the present inventive concept, in the state in which the glass is opened, the curtain is fixedly maintained in the state in which the curtain descends, and only after the glass is completely closed, the curtain may ascend and descend. This structurally prevents a phenomenon that the curtain ascends in the state in which the glass is opened, so that the curtain may be damaged due to strong wind introduced from the outside at the time of driving a vehicle. In other words, even in a state in which the curtain ascends slightly, the descent of the closed glass is structurally prevented.

In addition, with the above-mentioned structure, the glass and the curtain may ascend and descend using a single up/down button rather than using separate up and down buttons. When the up button is pressed in the state in which both of the curtain and the glass are opened, after the glass completely ascends, the curtain ascends. When the down button is pressed in the state in which both of the curtain and the glass are closed, after the curtain completely descends, the glass descends.

In addition, when the up button is pressed in the state in which the glass is closed and the curtain is opened, the curtain ascends. When the down button is pressed in the state in which the glass is closed and the curtain is opened, the glass descends.

According to an exemplary embodiment of the present inventive concept, a motor and a driving mechanism of a door curtain are omitted, such that cost and weight may be decreased. In addition, there is no limitation in a layout of a door trim or a door frame, such that a degree of freedom in a design may be increased. Further, an interior space is further secured, such that salability may be improved.

The respective components of the present inventive concept may be appropriately changed in a range in which their functions are not changed, and are not limited to the above-mentioned embodiment, but may be freely changed without departing from the scope and spirit of the present inventive concept defined by the following claims.

What is claimed is:

1. A curtain integrated door regulator structure comprising:

a motor generating a rotational driving force to rotate a driving shaft;

a drive gear having a shaft receiving hole into which the driving shaft of the motor is fitted a drum retainer having a spiral groove shaft supporting part spirally coupled to a spiral protrusion disposed on an outer circumference of the drive gear;

a glass driving drum and a curtain driving drum rotatably received in the drum retainer and disposed at an outer side of the drive gear;

gear keys disposed on the outer circumference of the drive gear; and key grooves formed in the glass driving drum and the curtain driving drum, respectively, and having a shape corresponding to that of the gear keys.

2. The curtain integrated door regulator structure according to claim 1, wherein the driving shaft and the shaft receiving hole are movable in an axial direction and are coupled to each other so as to transfer a rotational force in a rotation direction.

3. The curtain integrated door regulator structure according to claim 2, wherein the spiral protrusion disposed on the outer circumference of the drive gear moves along a spiral groove of the spiral groove shaft supporting part of the drum retainer while the drive gear is rotated by rotation of the motor, such that the drive gear moves in the axial direction while being rotated, and the drive gear moves in the axial direction, such that the gear key of the drive gear is selectively engaged with the key groove of the glass driving drum or the key groove of the curtain driving drum, thereby rotating the glass driving drum or the curtain driving drum.

4. The curtain integrated door regulator structure according to claim 1, further comprising stoppers fixing the glass driving drum and the curtain driving drum that is not engaged with the gear keys of the drive gear so as not to be rotated.

5. The curtain integrated door regulator structure according to claim 2, wherein the outer circumference of the drive gear has jaws, the stoppers have jaw receiving parts, respectively, and the stoppers have the jaws received in the jaw receiving parts thereof, respectively, such that they are rotatably coupled to the drive gear.

6. The curtain integrated door regulator structure according to claim 5, wherein the stoppers include stopper parts disposed in a direction parallel with the axial direction of the drive gear, respectively, and the drum retainer has guide grooves guiding the stopper parts in the direction parallel with the axial direction of the drive gear, respectively.

7. The curtain integrated door regulator structure according to claim 6, wherein when the drive gear moves in the axial direction, the stoppers also move in the axial direction by the jaw receiving parts, and rotation of the stoppers is prevented by the stopper parts and the guide grooves during a period in which the stoppers move in the axial direction together with the drive gear.

8. The curtain integrated door regulator structure according to claim 1, wherein the key groove of the glass driving drum and the key groove of the curtain driving drum are disposed to be spaced apart from each other by at least an axial length of the gear key disposed on the outer circumference of the drive gear.

9. The curtain integrated door regulator structure according to claim 4, wherein during a period in which the gear key of the drive gear is engaged with the key groove of the glass driving drum, the stopper part of the stopper is engaged with the curtain driving drum, thereby preventing rotation of the curtain driving drum, and during a period in which the gear key of the drive gear is engaged with the key groove of the curtain driving drum, the stopper part of the stopper is engaged with the glass driving drum, thereby preventing rotation of the glass driving drum.

10. The curtain integrated door regulator structure according to claim 4, wherein the stoppers are disposed at outer sides of the glass driving drum and the curtain driving drum in the axial direction of the drive gear.

* * * * *